United States Patent [19]

Rouget et al.

[11] 4,350,074

[45] Sep. 21, 1982

[54] MECHANICAL AND ELECTRICAL COUPLING DEVICE FOR CHARGES, PARTICULARLY MILITARY CHARGES

[75] Inventors: Jean P. Rouget; Edmond Roustant, both of Paris, France

[73] Assignee: Thomson-Brandt, Paris, France

[21] Appl. No.: 151,587

[22] Filed: May 20, 1980

[30] Foreign Application Priority Data

Jun. 7, 1979 [FR] France ..... 79 14591

[51] Int. Cl.[3] ..... B64D 1/04; F41F 5/02

[52] U.S. Cl. ..... 89/1.5 D; 244/137 R; 294/83 AE

[58] Field of Search ..... 89/1.5 D, 1.5 E, 1.5 F, 89/1.5 G, 1.5 H, 1.5 R, 1.812; 244/137 R; 294/83 AA, 83 AE

[56] References Cited

U.S. PATENT DOCUMENTS

| | | | |
|---|---|---|---|
| 2,939,102 | 5/1960 | Johnson | 89/1.5 D |
| 3,010,752 | 11/1961 | Geffner | 244/137 R X |
| 3,041,937 | 7/1962 | Toomey | 102/262 X |
| 3,787,012 | 1/1974 | Jakubowski | 89/1.5 R X |
| 3,887,150 | 6/1975 | Jakubowski | 89/1.5 B X |
| 4,026,188 | 5/1977 | Woodruff et al. | 89/1.5 R |
| 4,132,377 | 1/1979 | Schorr | 89/1.5 B X |

FOREIGN PATENT DOCUMENTS

| | | | |
|---|---|---|---|
| 859458 | 1/1961 | United Kingdom | 89/1.5 F |

*Primary Examiner*—David H. Brown

*Attorney, Agent, or Firm*—Oblon, Fisher, Spivak, McClelland & Maier

[57] ABSTRACT

The invention concerns a mechanical and electrical coupling device for charges, particularly military charges. Such a coupling consists of a combination of hanging, steadying and electrical connection means arranged in such a way that the locking of the hanging means simultaneously and automatically ensures the steadying of the carried charge in all positions with respect to the carrier charge, as well as their electrical connection, without there being any need to perform adjustment operations. A plurality of charges may thus be firmly connected together for purposes of transporting them under an aircraft and subsequently ejecting them one by one, beginning with the one furthest from the aircraft. The invention is applied to the dropping of projectiles in strings.

3 Claims, 12 Drawing Figures

FIG_1
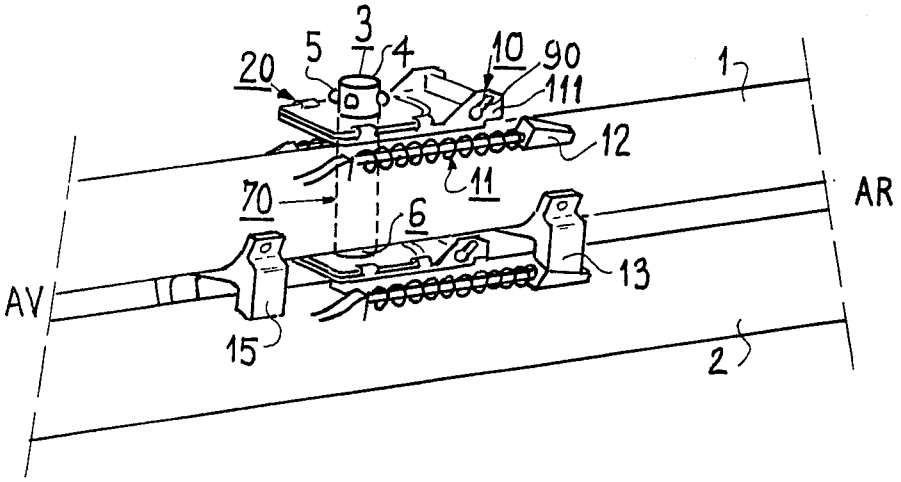
FIG_2-a
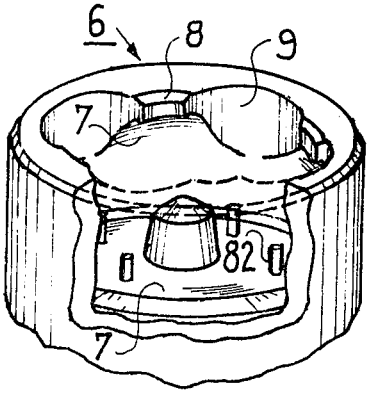
FIG 2-b
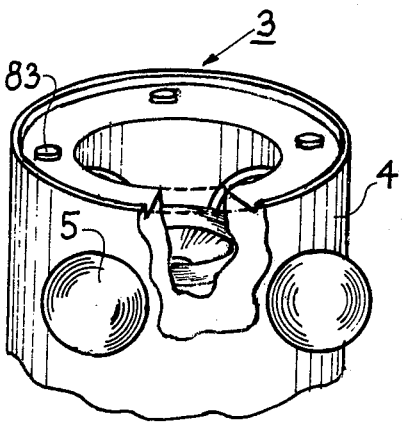

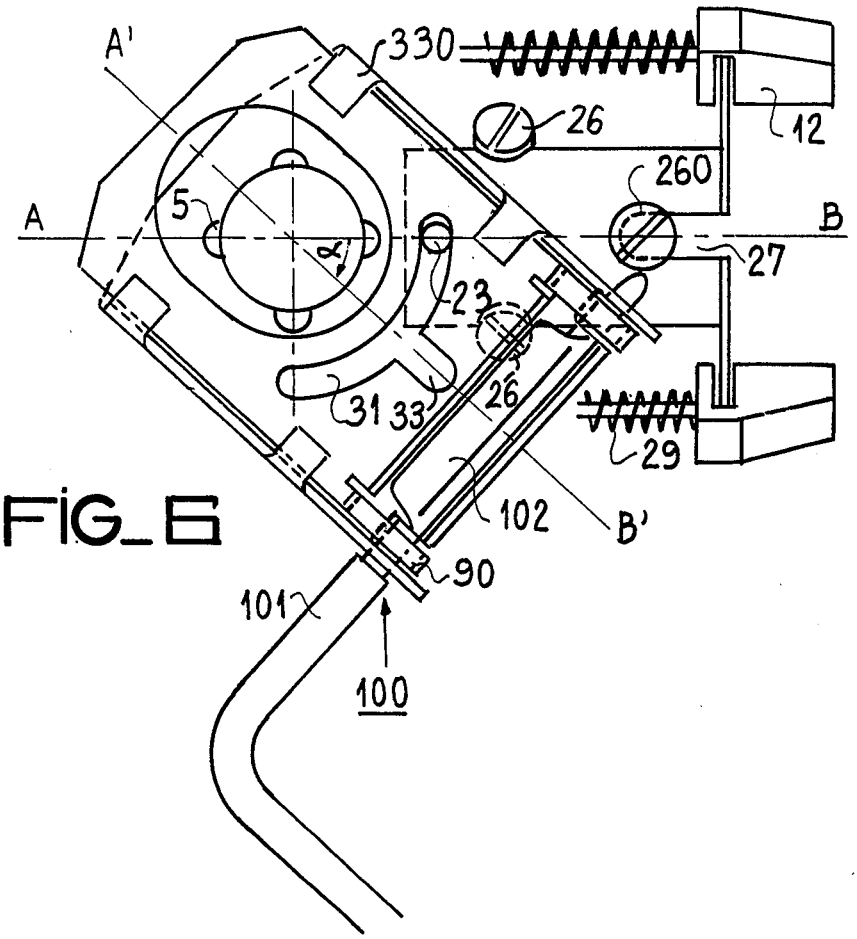
FIG_6
FIG_7-a
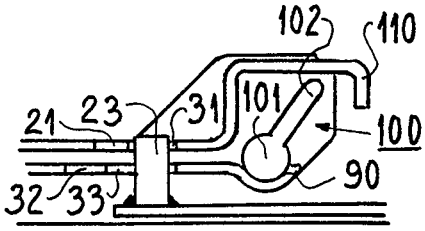
FIG_7-b
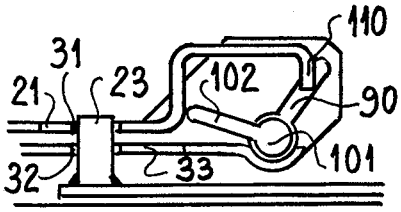

FIG_8
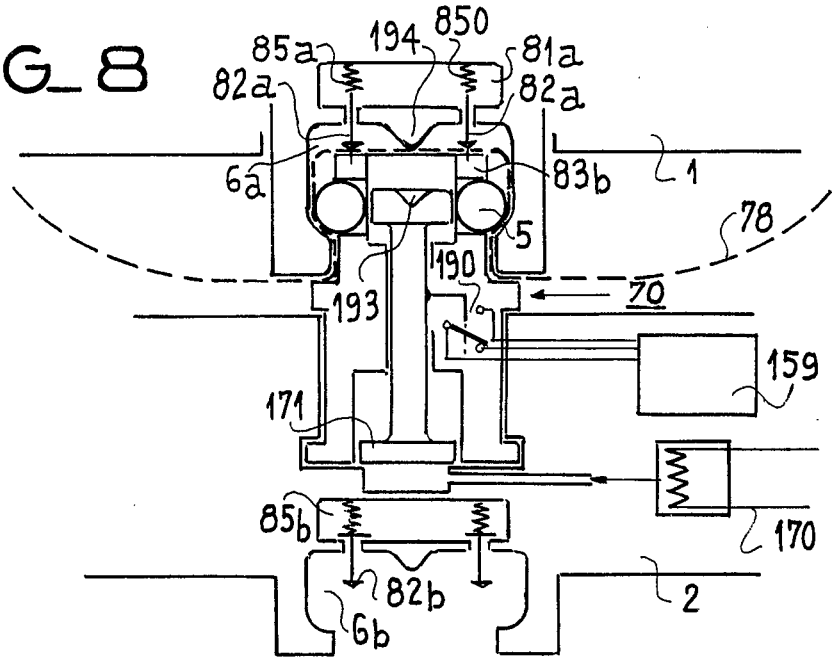
FIG_9-a
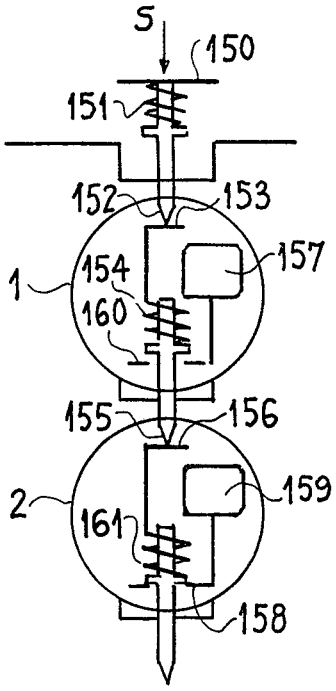
FIG_9-b
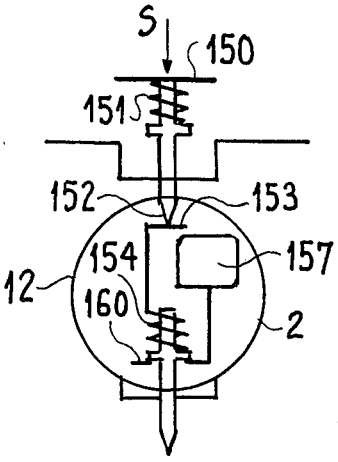

MECHANICAL AND ELECTRICAL COUPLING DEVICE FOR CHARGES, PARTICULARLY MILITARY CHARGES

BACKGROUND OF THE INVENTION

1. Field of the Invention

The invention concerns a mechanical and electrical coupling device for airborne charges, particularly military charges, such as projectiles. It also concerns projectiles equipped with such devices.

More specifically, the invention concerns such a coupling device capable of simultaneously fulfilling the functions of hanging and steadying a plurality of charges, e.g., projectiles, so as to transport them under an aircraft, and of ejecting them one by one, beginning with the one located furthest from said aircraft. 2. Description of the Prior Art One means of transporting multiple charges under an aircraft consists of fastening to a pylon which is integral with the aircraft an intermediate piece generally called an "adapter", having a plurality of fastening sites for the charges to be transported. At each of these sites are installed elements enabling handing, steadying, safety control, and ejection of the charge. On planes flying at present day speeds, an ejection system is generally installed in the adapter in order to eject the charge downward at a specified speed. At each site, installation of the charge requires, in succession, hanging, then steadying (generally using wedging screws carried on arms), and finally electrical or mechanical connection with safety control elements. The ejector, which is generally explosive, is included in the adapter at each site. It is activated by a powder impeller. Because on such adapters it is possible to hang and eject only one charge per site, a mission requiring the successive release of a great number of charges (e.g., a drop in a string) poses considerable problems if the number of pylons is not sufficient or if one must reserve some of them for other uses.

SUMMARY OF THE INVENTION

The purpose of the present invention is to remedy these problems. It concerns a coupling device integral with each of the charges and comprising a combination of means cooperating mutually to accomplish the following four essential functions: hanging of one charge upon another, steadying of each of the charges thus hung on the preceding, the electrical connection required for use of the sequencers with which the charges are equipped, and ejection of said superposed charges one after another, beginning with the charge furthest from the adapter.

The present invention more specifically concerns a mechanical and electrical coupling device for charges, particularly military charges, with a view toward their transport under an aircraft, characterized in that it comprises a combination of hanging, steadying, electrical connection, and ejection means ensuring the mechanical hanging of a plurality of charges of successive rows n, (n−1), (n−2), . . . with (n) being the row of the charge furthest from the aircraft during transport; said means working together in order, during the hanging phase, to assure simultaneously and automatically, without adjustment operations, the mechanical and electrical coupling of the various charges, and in order, during the phase of dropping these charges from the aircraft, to assure their ejection one by one, with the one on row (n) being ejected alone and in first position, followed by the charge on row (n−1), then the charge on row (n−2) and so on.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views, and wherein:

FIG. 1 represents schematically two charges assembled by means of a coupling device according to the invention;

FIG. 2 represents schematically enlarged details of elements of FIG. 1;

FIGS. 3 to 7 represent, in cross-section and in front view, the essential parts of the element ensuring the hanging and steadying of the various charges with respect to each other;

FIG. 8 represents a connection element containing in particular elements ensuring the electrical connection and ejection of the charges; and FIG. 9 shows explanatory diagrams.

DETAILED DESCRIPTION OF THE PREFERRED EMBODIMENTS

Figure 3:
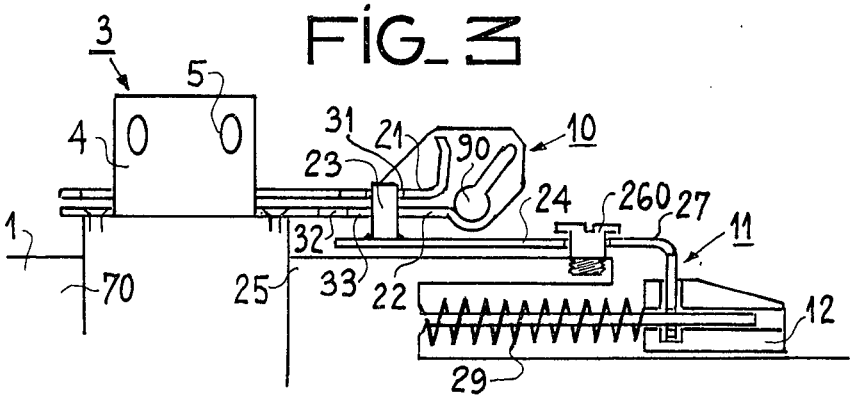

For greater clarity, identical elements are referred to by the same numbers in all the figures.

In FIG. 1, two charges are partially represented, hung one upon the other by means of a coupling device according to the invention. In fact this number is not limitative, and a succession of charges may therefore by superposed. This may involve projectiles in particular, such as bombs intended to be transported under airplanes and later dropped one by one. FIGS. *2a* and *2b* each represent a detail of FIG. 1. The first and second bombs 1 and 2 are called the carrying bomb, of row (n−1), and the carried bomb, of row (n). The number (n) is a function of the resistance criteria of the materials and of the mechanical stress brought into play. Only a part of these bombs is represented, deleting the forward part (Av) and the rear part (Ar). The coupling device of the invention is referred to generally as 20. It comprises essentially a combination of mechanical hanging and steadying means, electrical control signal transfer means, and ejection means. It may be an integral part of the body of the charge (as in the example described). But it may be independent and is then firmly connected to the charge by any means which does not compromise the aerodynamic qualities of the whole. In all cases it is positioned close to the center of gravity of the charge.

The hanging and steadying means comprise essentially a connection element 70 connecting a male part 3 and a female part 6. The first part, in one sample embodiment, comprises a pivotable cylinder 4 having balls 5 and a system of conducting contacts 82 (FIG. *2b*), the function of which will be described further on. The second part 6, called the stationary base, comprises, shown in FIG. *2a*, a cavity 7 delimited by a rim 8 which is interrupted by sockets 9. It further comprises a set of movable contacts 82 which are good conductors of electricity and are intended to cooperate, as will be explained below, with stationary contacts 83 of the pivotable cylinder. The number and arrangement of balls 5 on the periphery of fastening cylinder 4 and the distribution of sockets 9 within cavity 7 are such that in an initial phase the fastening cylinder of the carried bomb, having rotated by a certain angle, can be inserted within cavity 7 of carrier bomb 1, with the balls thus coinciding with sockets 9, along which they can slide, while in a second phase, with cylinder 4 carrying balls 5 having resumed its initial position, balls 5 are supported by rim 8 of cavity 7, which plays the role of a mount for balls 5. The fastening together of carrier bomb 1 and carried bomb 2 is thus ensured. Means 10 are provided to ensure rotation of fastening cylinder 4, having balls 5, while additional means 11 ensure displacement of keying wedges 12 intended to cooperate with the oblique surfaces of a support 13. The carried bomb is then steadied in three directions, by virtue of the coordinated action of the connection by the fastening cylinder, keying wedges and supports 13, as well as additional stationary rests 15, the shape of which essentially matches that of the body of the bomb. As will be explained below, a housing 90 provided in an angle piece 111 is provided in order to receive a key, the rotation of which causes the rotation of cylinder 4 carrying balls 5.

These various means will now be described in greater detail by means of the following figures, particularly FIGS. 3 through 7.

Figure 4:
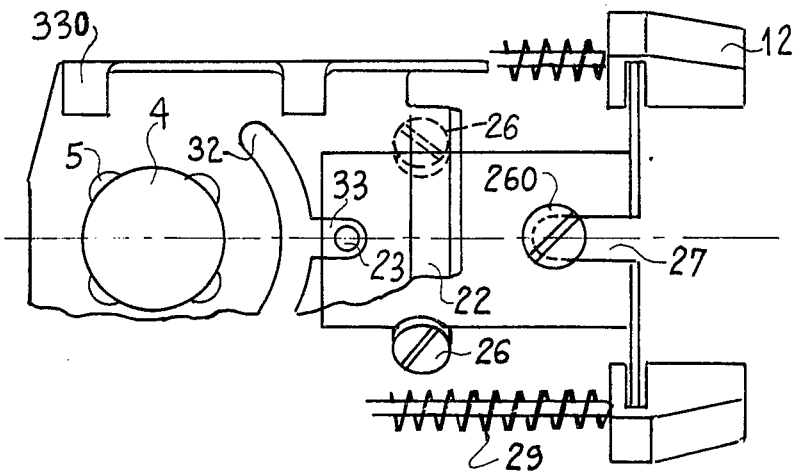

FIGS. 3 and 4 represent schematically, in cross-sectional and top views, means 10 and 11 designed respectively to ensure displacement of fastening cylinder 4 having balls 5 and of keying wedges 12. These means are represented in the figures in a configuration which corresponds to the state called the rest state, i.e., that corresponding to storage of the bombs before hanging for transport. Carrying bomb 1 on which is to be hung an initial carried bomb 2 is equipped with a device according to the invention. Beside male part 3, with its fastening cylinder 4 and balls 5, there work together a slide bar, called the upper slide bar and labelled 21, on which acts the key inserted in housing 90, and a slide block labelled 22, which is firmly connected to fastening cylinder 4 and causes it to rotate. A pin 23 coordinates the movements of upper slide bar 21 and slide block 22 and is integral with a second slide bar called the lower slide bar and labelled 24, which is attached to casing 25 by means of plugs 26 and 260 which enable it to slide between the casing and the head of said plugs. Said slide bar 24 comprises an opening 27 which enables slide bar 24 to slide at central plug 260 (FIG. 3), along the entire length of opening 27. Said slide bar 24 is also firmly affixed to keying wedges 12, which follow its movement but are returned to their initial rest position by means of a return spring 29. In the example described, the device of the invention is an integral part of the bomb, i.e., casing 25 is one with the shell (or body) of the bomb, but, as stated earlier, such a device may be constructed in the form of an independent piece. Slide bar 21 and slide block 22 each have a guide path 31 and 32 for pin 23. They have the same outline, which nevertheless is not superposed in the rest state. Thus, pin 23 is level within guide path 31 of slide bar 21. The outline of said guide path 31, seen in plan view, is not represented, but it is the same as the outline of guide path 32 of the second guide bar, which is shown in FIG. 4. FIG. 4 has been represented, from above, in a configuration where upper slide bar 21 has been removed so as to facilitate description and comprehension. In addition, slide block 22 comprises a second longitudinal guide path 33. Finally, slide bar 21 and slide block 22 are held together by tabs 330, which enable the relative movement in two parallel planes of said pieces 21 and 22. Fastening of the first, carrier bomb 1 to the second, carried bomb 2 is carried out in particular by means of the cooperation of said slide bar and said slide block, the movement of which is ensured by pin 23 as now described and illustrated with reference to FIGS. 5 and 6.

Figure 5:
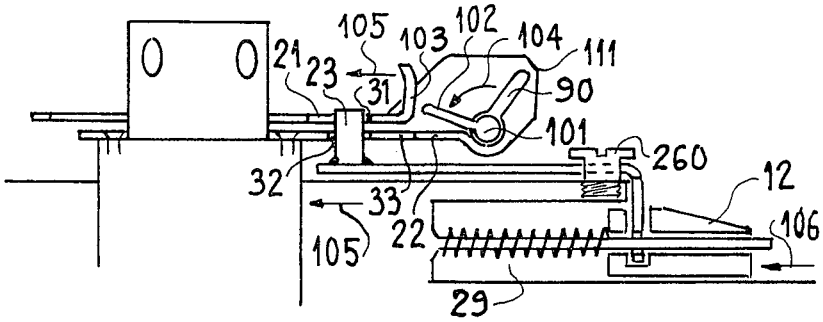

FIG. 5 represents, in cross-section, the position of the different elements making up the actual system of hanging and steadying, i.e., slide bar and slide block 21 and 22, and pin 23 guided by guide paths 31, 32, and 33. Springs 29 and keying wedges 12, said elements being made to move by means of key 102 when the key is in a position such that pin 23 is unlocked. FIG. 6 is a plan view of the same hanging and steadying system in an intermediate configuration following unlocking and preceding locking, represented in the preceding figure, in the course of which pin 23, guided within now superimposed curved guide paths 31 and 32, causes the rotation of slide block 22 and cylinder 4 which is integral with it.

To do this, key 100 comprises a control lever 101 and bolt 102 capable of applying a force to upper slide bar 21 over a curved part of the latter called staple 103 by analogy with bolt 102. As the operator presses bolt 102 of key 100 onto staple 103 of upper slide bar 21, in the direction of arrow 104 (FIG. 5), the set of upper and lower slide bars 21 and 24 moves in the direction of arrow 105. Pin 23, first guided by longitudinal guide path 33, drives lower slide bar 24 until guide path 32 coincides with guide path 31 of upper slide bar 21, paths the outlines of which are identical and curved as described above. At this instant, it becomes possible for the operator, by acting on control arm 101 of key 100, to cause the assembly of the upper slide bar and the slide block 21 and 22 to turn in such a way as to cause cylinder 4 to turn, until balls 5 face sockets 9 of cavity 7 of second bomb 2 which is to be carried and fastened to first, carrier bomb 1, so as to lock the balls into rim 8 of said cavity, thus assuring the desired fastening. FIG. 6 represents schematically an intermediate configuration showing clearly the angle $\alpha$ already existing between longitudinal axis AB of the device and longitudinal axis A'B' of the upper slide bar and slide block system. Simultaneously, pin 23 has driven lower slide bar 24 in longitudinal displacement in the direction of arrow 105, compressing return springs 29 and displacing keying wedges 12 toward fastening cylinder 4. Following arrow 106 (FIG. 5), said keying wedges are then in a position enabling placement at their level of the oblique surface of stationary support 13, called the oblique contact support. When the operator proceeds with this last step, i.e., that of locking the second bomb to the first by acting upon the key in the direction opposite that which has just been described, each element resumes the position it occupied in the prior rest state described above. In particular, the recoiling keying wedges are applied to support 13, thus ensuring the steadying of the carried bomb, which is also held both by the hanging system and stationary curved contact support 15. It is immobilized in all directions without it being necessary to make use of sophisticated steadying adjustments.

Key 100 and housing 90 in which it is inserted by the operator in order to carry out the fastening or unfastening of two bombs, as just described, work together in such a way that said key can be removed from the housing only when locking is complete, i.e., when the device is in the rest state during storage or has resumed this state after the operation of hanging the carried bomb.

FIGS. 7*a* and 7*b* illustrate this combination for carrying out locking checks.

In FIG. 7*a*, the upper slide bar and the slide block occupy a position corresponding to the one shown in FIG. 1. Key 100 is introduced into housing 90 provided for this prupose. Upper slide bar 21, and more particularly staple 103 of said slide bar, onto which bolt 102 of key 100 is to come to rest, is extended in a beak 110. In the rest position (FIG. 7*a*), the key may be inserted or withdrawn without difficulty, with housing 90 not being cut off by said beak 110. On the other hand, as illustrated in FIG. 7*b*, when the key has fulfilled its function, i.e., when it has brought the slide bar and slide block 21 and 22 into the position represented in particular in FIGS. 6 and 7*b*, the operator cannot in any case remove the key: in fact, housing 90 is partially cut off by beak 110. He must therefore either continue the operation or go backwards. Under these conditions, it is always easy to be sure of the proper locking of all bombs hung from one another by means of the device of the invention. It suffices to observe that no keys remain after assembly, and if one has been forgotten by error, to check whether it is possible to remove it and carry out that action.

The hanging, locking and steadying function has just been described, but according to another characteristic of the invention, such a device also comprises a connection element (reference 70 in FIG. 1) between ball-carrying cylinder 4 and cavity 7, an element which contains the electrical transfer elements and ejection means.

FIG. 8 illustrates schematically a sample embodiment of such a connection element 70. The two charges (from the example describing carrier bomb 1 and carried bomb 2) are represented. The separation surface at the level of ball-carrying cylinder 4 of carried bomb 2 is symbolized by dotted line 78. The electrical transfer system will be described first. Each female part 6, labelled 6*a* in the case of bomb 1 and 6*b* in the case of bomb 2, comprises a plurality of movable contacts 82*a* and 82*b*. In the example described, there are four of these uniformly distributed over crown 85*a* and 85*b*, only two of which are visible in FIG. 9. Stationary contacts 83*b* (the stationary contacts of bomb 1 do not appear in FIG. 8), of a number equal to the number of movable contacts 82*a*, are provided and distributed in the same manner over a crown on ball-carrying cylinder 4. The arrangement of these movable and stationary contacts is such that they work together to provide, when applied against each other, a good electrical contact. In FIG. 8, crown 85*a*, forming part of cavity 6*a* of carrier bomb 1, and movable contacts 82*a* (symbolized by the presence of springs 850) come to rest on stationary contacts 83*b* of ball-carrying cylinder 5 of carried bomb 2. At the lower etremity of connection element 70 there are also represented movable contacts 82*b* borne by crown 85*b*, which is part of cavity 6*b* of carried bomb 2. Connection element 70 also comprises a sequencer 159 which receives electrical commands issued by the pilot of the aircraft and leading to the adapter hung onto the pylon of said aircraft. The commands are conveyed in the following manner, illustrated schematically by FIGS. 9*a* and 9*b*.

In FIG. 9*a*, two bombs are fastened together, a carrier bomb 1 (of row n−1) in the upper position, and a carried bomb 2 (of row n) in the lower position (this number of two is given solely by way of example). In FIG. 9*b*, a single bomb remains hung onto the adapter of the carrier vehicle (not shown). Signal S is applied to the first movable contact 150, in the case of FIG. 9*a*, following the conductor path constituted by spring 151, point 152 applied to stationary contact 153, second spring 154, and point 155 applied to second stationary contact 156 connected to sequencer 159 by spring 161, with contact 158 closed in contrast to contact 160, which is open. Sequencer 157 is out of the circuit and therefore in this sequence receives no pulse. It follows that only sequencer 159 will be activated and able to deliver control signals, ensuring the proper progression of the rest of the programmed operations. In the case where only a single bomb still remains hung, contact 160 is, by contrast, in closed position and this signal is thus applied to sequencer 157, which may then fulfill its function. In the example described, as stated previously, there are four stationary and movable contacts. Three of these contacts are used to control the sequencers and the fourth for triggering an explosive charge 170, as shown in FIG. 8. The electrical transfer circuit designed to control the firing of said explosive charge 170 follows the same process as that which has just been described for the various sequencers, i.e., only the explosive charge for the lowest bomb (bomb of row n) is fired, with the bomb of row (n-1) being able to be fired only when the bomb of row (n) has itself been ejected. The firing of an explosive charge, e.g., charge 170 of FIG. 8, causes a piston 171 to move, which fulfills two functions, the first being to close a switch 190 enabling the sequencer to deliver various previously programmed command orders, and the second to release balls 5 when the hollow impression 193 of the piston comes together with the relief impression 194 of the female part of upper bomb 1. Retracted, the balls no longer support the carried bomb furthest from the aircraft and it is ejected at a speed which depends on the explosive charge used.

All of the charges thus suspended are successively ejected one after the other, with the lower charge of row (n) always being ejected before that of row (n−1), which in turn always goes before that of row (n−2) and so on.

The invention is applied in particular to weapons systems requiring the successive release of a great number of military charges, such as bombs or various projectiles.

What is claimed as new and desired to be secured by Letters Patent of the United States is:

1. A device for sequentially coupling and separating a plurality of projectiles carried under an aircraft, wherein said device comprises the following elements:

a male element associated with a projectile and engageable for snap-fastening by rotation within a corresponding female element placed on an adjacent projectile, said male element being provided with a first hollow cylindrical member which is capable of rotating about its longitudinal axis with respect to the projectile body, a plurality of balls inserted in the external wall of said first cylindrical member, said balls being disposed in uniformly spaced relation and maintained in position by the head of a piston internal to and concentric with said first cylindrical member, said piston being capable of sliding along the longitudinal axis of said first cylindrical member;

a cylindrical female element engageable for snap-fastening around a corresponding said male element and placed on the adjacent projectile, said female element being provided with a second hollow cylindrical member which is stationary with respect to the adjacent projectile body, the distal end of said second cylindrical member being provided with a snap-fastening rim interrupted by sockets; and a plate fixed to said first cylindrical member and fitted with a locking member actuated by a movable key for rotating said first cylindrical member relative to said second cylindrical member between a first position in which said balls are released by said sockets and a second position in which said balls are retained by said rim.

2. A device in accordance with claim 1 further comprising:

two stationary support members located on each side of said female element, one of said support members being provided with bearing surfaces applied against the projectile body and the other support member being provided with oblique bearing surfaces;

keying support wedges retractable in a direction parallel to the axis of the projectile, said keying wedges being provided with flat oblique bearing surfaces and being displaceable by said locking member of said male element.

3. A device in accordance with claim 1, wherein the male element is provided with a series of electrical contacts connected respectively by means of flexible connections to a series of retractable electric contacts located within the female element.

* * * * *